United States Patent [19]

Myers et al.

[11] 3,998,379

[45] Dec. 21, 1976

[54] COIN ROLL BOX

[75] Inventors: Edward Myers, Streamwood; James B. Hale, Deerfield; James S. Mentzer, Park Ridge, all of Ill.

[73] Assignee: Cummins-Allison Corporation, Glenview, Ill.

[22] Filed: Mar. 17, 1976

[21] Appl. No.: 667,869

[52] U.S. Cl. ..... 229/33; 229/23 R

[51] Int. Cl.[2] ..... B65D 5/22

[58] Field of Search ..... 229/6 A, 33, 36

[56] References Cited

UNITED STATES PATENTS

| | | | |
|---|---|---|---|
| 610,255 | 9/1898 | Bisler | 229/33 |
| 1,143,103 | 6/1915 | Cameron | 229/33 X |
| 1,824,927 | 9/1931 | Powell | 229/33 X |
| 2,019,995 | 11/1935 | Rippen | 229/23 B X |
| 2,311,403 | 2/1943 | Lighter | 229/36 X |
| 2,389,580 | 11/1945 | Skell | 229/23 R |
| 2,401,742 | 6/1946 | Bentham | 229/23 R X |
| 2,573,706 | 11/1951 | Grant | 229/23 R |
| 2,588,232 | 3/1952 | Grant | 229/23 R |
| 2,608,340 | 8/1952 | Donnell | 229/33 |
| 3,112,058 | 11/1963 | Martin | 229/36 |

*Primary Examiner*—Davis T. Moorhead
*Attorney, Agent, or Firm*—Leydig, Voit, Osann, Mayer & Holt, Ltd.

[57] ABSTRACT

A coin roll box formed from a unitary blank of cardboard or the like has a pair of adjacent side walls detachable from each other and from a pair of adjacent end walls and integrally hinged to the other adjacent side walls so as to form a pair of adjacent lids that can be independently opened for loading and inspection of the coin rolls. When one of the lids is opened, the coin rolls can be packed into the box by an automatic packaging system which rolls the coin rolls into the box by gravity. When the other lid is open, the number of coin rolls in the box can be checked by viewing the ends of the coin rolls packed in the box. The box walls form a plurality of internal flaps with tabs that fit into complementary slots in adjacent walls of the box to hold the box together and to hold the flaps against the respective walls over which the flaps are folded so that the flaps do not interfere with the loading of coin rolls into the box. When the first lid is open, the internal dimension between the second lid and the opposed side wall of the box is only slightly greater than the length of one of the coin rolls, so that these two internal surfaces of the box serve to guide the coin rolls and prevent the skewing thereof during the packing of the coin rolls into the box. The entire box can be held securely together by a single staple or other suitable fastening device.

10 Claims, 9 Drawing Figures

COIN ROLL BOX

DESCRIPTION OF THE INVENTION

The present invention relates generally to containers and, more particularly, to an improved box for use in the automatic packaging and subsequent shipment and handling of coin rolls.

It is a primary object of the present invention to provide an improved coin roll box that assures the reliable packing of a preselected number of coin rolls therein, while also facilitating inspection of the number of coin rolls in the box after it has been packed.

It is another object of this invention to provide an improved coin roll box of the foregoing type which is particularly suitable for use in an automatic packaging system that rolls the coin into the box by gravity, and which can later be opened to expose the ends of the coin rolls in the box for checking the number of rolls that have been packed in the box.

A further object of the invention is to provide such an improved coin roll box that can be efficiently formed from a single unitary blank of corrugated cardboard or the like, and which can be easily fabricated in different sizes to accommodate rolls of coins of different denominations.

Still another object of the invention is to provide such an improved coin roll box that can be held securely together by a single staple or other suitable fastening device.

Other objects and advantages of the invention will be apparent from the following detailed description and the accompanying drawings in which.

While the invention will be described in connection with certain preferred embodiments, it will be understood that it is not intended to limit the invention to those particular embodiments. On the contrary, it is intended to cover all alternatives, modifications, and equivalents as may be included within the spirit and scope of the invention as defined by the appended claims.

Figure 1:
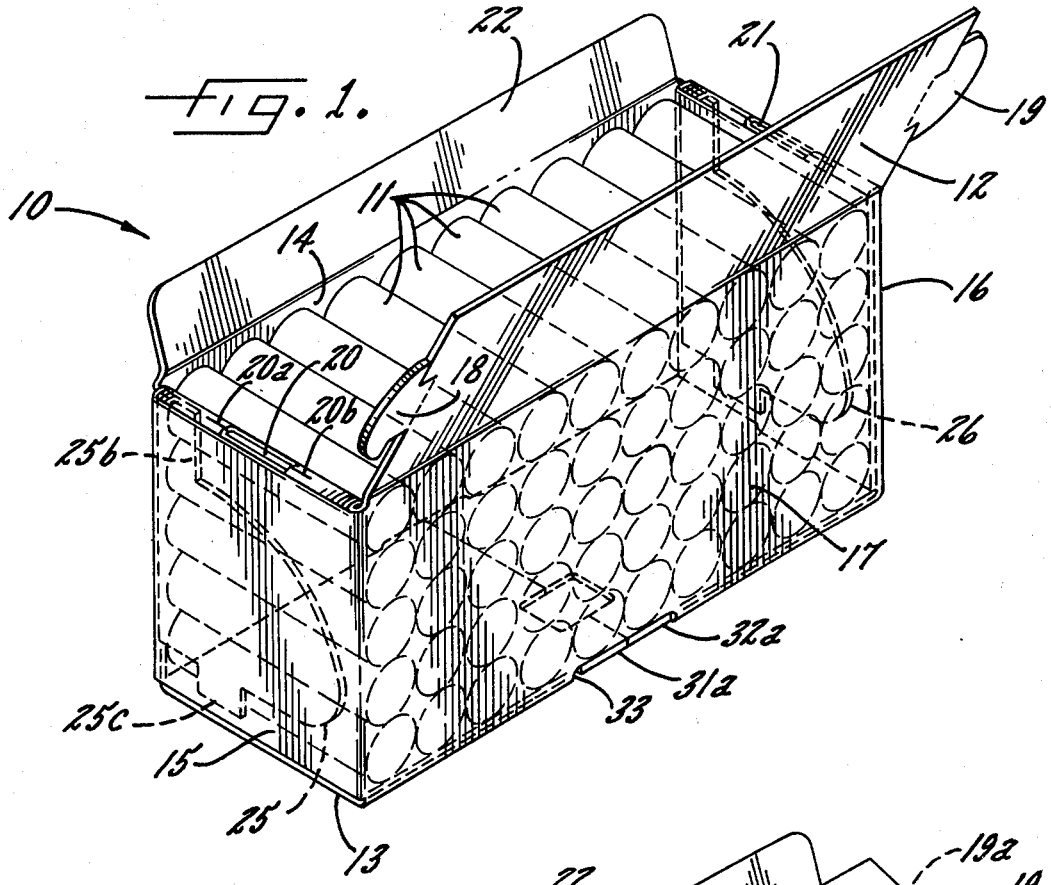
FIG. 1 is a perspective view of a coin roll box embodying the invention and filled with coin rolls that have just been loaded into the box.

Turning now to the drawings and referring first to FIG. 1, a box 10 is illustrated in the form in which it is mounted on an automatic coin roll packaging system of the type described in the assignee's co-pending U.S. patent application Ser. No. 643,368, filed Dec. 22, 1975 in the name of Daniel D. Call and entitled "Coin Roll Packaging Sysem." The illustrative box 10 has been loaded with a 5 × 10 array of 50 coin rolls 11. The automatic loading of the coin rolls 11 into the box 10 is effected by mounting the box on the packaging machine with the lid 12 open and with the wall 13 on the bottom and disposed at an angle of about 45° to horizontal. The automatic packaging system then rolls coin rolls into the box by gravity until the box is completely filled, indicating a count of . Since the box thus serves as a counting device, as well as a container for the coin rolls, it is important that the interior walls of the box be as smooth and continuous as possible to prevent the coin rolls 11 from becoming hung up on the walls of the box during the packing operation.

In accordance with one important aspect of the present invention, a pair of adjacent side walls of the box are detachable from each other and from a pair of adjacent end walls and are integrally hinged to the other adjacent side walls so as to form a pair of adjacent lids that can be independently opened for loading and inspection of the coin rolls, and the box walls form a plurality of internal flaps with tabs that fit into complementary slots in adjacent walls of the box to hold the box together and to hold the flaps against the respective walls over which the flaps are folded so that the flaps do not interfere with the loading of coin rolls into the box. Thus, in the illustrative embodiment, the side wall that forms the lid 12 is detachable from a second lid 14 formed by an adjacent side wall 14. Both of the lids 12 and 14 are also detachable from a pair of double-thickness end walls 15 and 16 and are integrally hinged to the adjacent side walls 17 and 13, respectively.

The walls 15, 16 and 17 are all just slightly wider than the length of a single coin roll so that when the lid 12 is open, coin rolls 11 can be rolled into the box and stacked therein without skewing. That is, the box walls serve as guides to maintain the coin rolls substantially parallel to each other during the loading thereof. When the box is filled with the desired number of coin rolls (50 in the illustrative example), the lid 12 is folded down onto the end walls 15 and 16 with a pair of integral tabs 18 and 19 on opposite ends of the lid 12 entering a pair of complementary slots 20 and 21 formed in the top edges of the double-thickness end walls 15 and 16, respectively. The slots 20 and 21 will be described in more detail below. To facilitate the closing of the lid 12, the tab 19 is made slightly longer than the tab 18 so that it is not necessary for both tabs to enter their respective slots at the same time.

Figure 4:
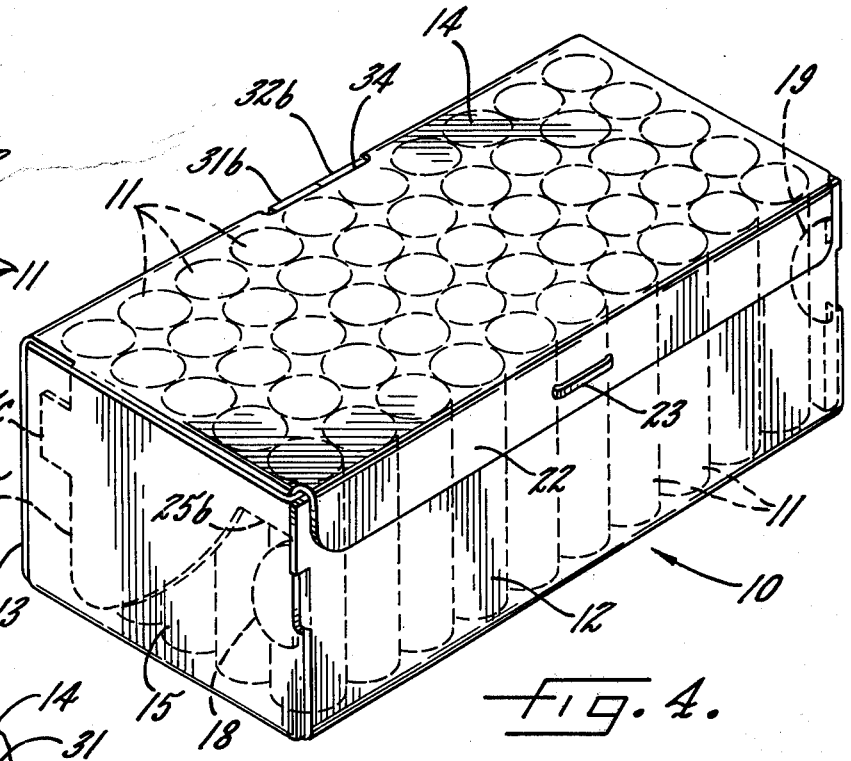
FIG. 4 is a perspective view of the same box illustrated in FIGS. 1 and 2 rotated 90° in a clockwise direction, and showing the box fully closed and secured by a fastening device.

After the lid 12 has been folded all the way down against the top edges of the end walls 15 and 16, with the tabs 18 and 19 fully inserted in the slots 20 and 21, a flap 22 on the adjacent lid 14 is folded over the lid 12 and secured thereto by a staple 23 (FIG. 4) or other suitable fastening device. As will be apparent from the ensuing discussion, this single staple 23 secures the entire box so that the coin rolls can be safety handled and shipped therein.

When it is desired to check the number of coin rolls 11 in the box 10, the second lid 14 is opened so that the inspector can view the ends of the coin rolls (which are not visible when the lid 12 is open). As can be seen most clearly in FIG. 5, when the lid 14 is closed (FIG. 4) or only partially open (FIG. 5), a pair of integral flaps 25 and 26 formed on opposite ends of the lid 14 fit between the two layers of the double-thickness end walls 15 and 16, respectively, thereby detachably connecting the lid 14 to those end walls. The previously described flap 22 is also formed as an integral extension of the elongated free edge of the lid 14.

Figure 6:
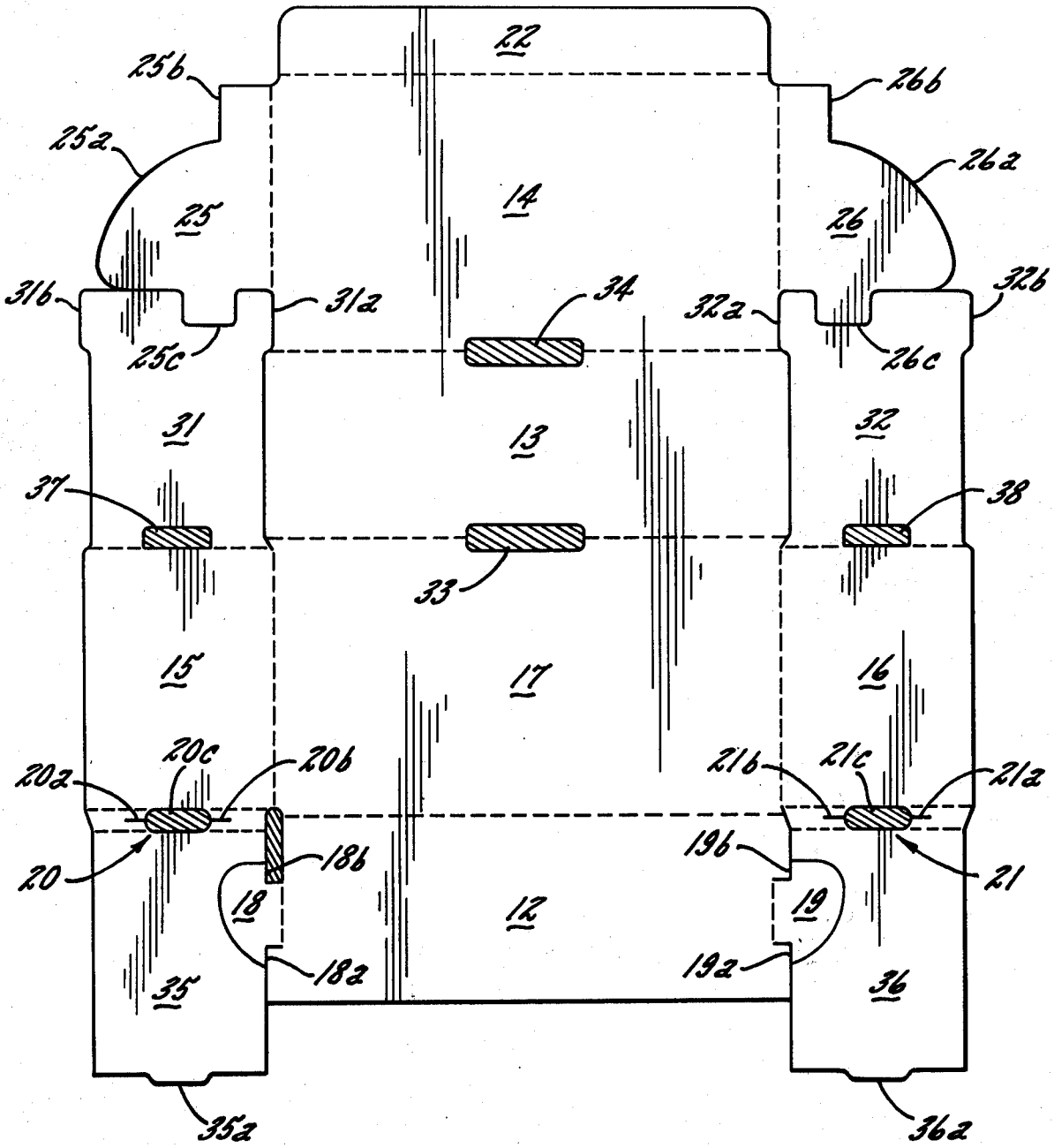
FIG. 6 is a plan view of a blank that has been cut to form the box of FIGS. 1–5, with the fold lines shown as broken lines.
Figure 7A:
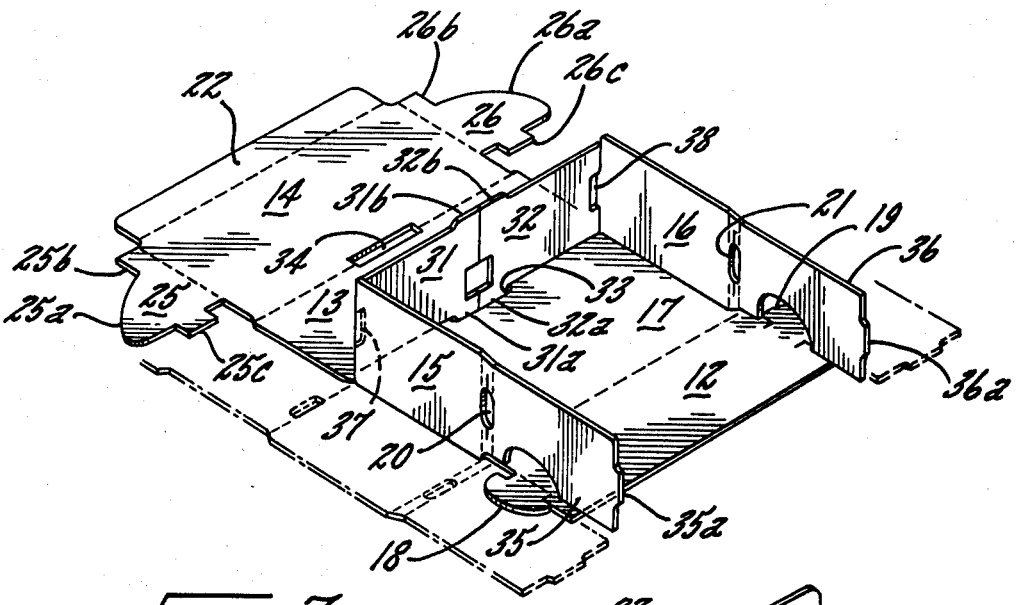
FIGS. 7*a*–7*c* are perspective views illustrating the blank of FIG. 6 being formed into the box of FIGS. 1–5, the three figures illustrating the blank in successive stages intended to the forming process.
Figure 7B:
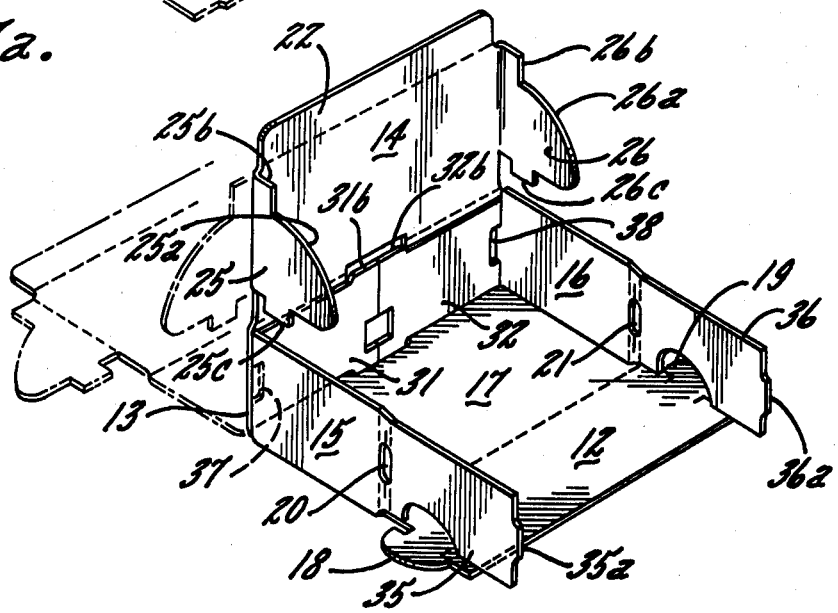
Figure 7C:
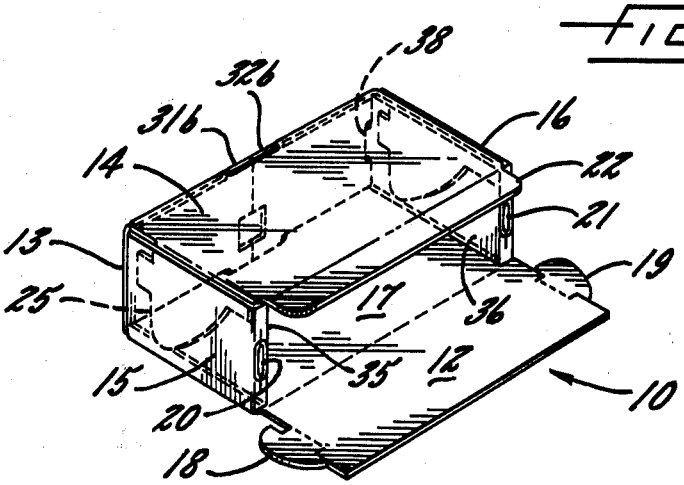

The illustrative box is particularly useful in automatic packaging systems which roll the coin rolls into the box by gravity, because the box provides interior wall surfaces which do not interfere with the rolling and stacking of coin rolls therein. The particular features of the box which provide this advantage will be more clearly understood from a more detailed description of the manner in which the box is formed. Thus, the starting blank for the box is illustrated in FIG. 6, and the sequence of manipulations involved in forming the box from the blank are illustrated in FIGS. *7a–7c*. It will be appreciated that the solid lines in the plan view of the blank in FIG. 6 represent die cut lines, while the broken lines represent fold lines.

As illustrated in FIG. *7a*, the first step in forming the box from the blank is to fold the end walls 15 and 16 upwardly from the side walls 13 and 17 and the lids 12 and 14. A pair of flaps 31 and 32 formed as integral extensions of the end walls 15 and 16, respectively, are then folded inwardly until they are aligned with the fold line between the side walls 13 and 17, as illustrated in FIG. *7a*. At this point, a pair of integral tabs 31*a* and 32*a* on the flaps 31 and 32 come into register with a slot 33 formed in the center of the fold line between the walls 13 and 17. The tabs 31*a* and 32*a* snap into this slot 33, thereby locking the flaps 31 and 32 in place.

Next, the side wall 13 and the lid 14 are folded upwardly along the fold line between the walls 13 and 17, until the wall 13 is positioned flat against the flaps 31 32, as illustrated in FIG. *7b*. At this point, the flaps 25 and 26 on the ends of the lid 14 are folded inwardly until they are perpendicular to the lid 14.

Turning next to FIG. *7c*, the lid 14 with the inturned flaps 25 and 26 is bent downwardly along the fold line between the lid 14 and the wall 13, thereby capturing tabs 31*b* and 32*b* on the flaps 31 and 32 within a slot 34 formed in the center of the hinge line for the lid 14. Next, a second pair of flaps 35 and 36 formed as integral extensions of the end walls 15 and 16 are folded inwardly through an angle of 180° so that they lie flat against the inside surfaces of the end walls 15 and 16, thereby forming the inner plies of the double-thickness end walls. As the flaps 35 and 36 are folded against the end walls 15 and 16, tabs 35*a* and 36*a* on the ends of the flaps snap into a pair of complementary slots 37 and 38 formed in the flaps 31 and 32 directly adjacent the fold lines between the flaps 31 and 32 and the end walls 15 and 16. Thus, the flaps 35 and 36 are held captive against the end walls 15 and 16, with the flaps 25 and 26 captured between the two layers of the resulting double-thickness end walls.

Figure 5:
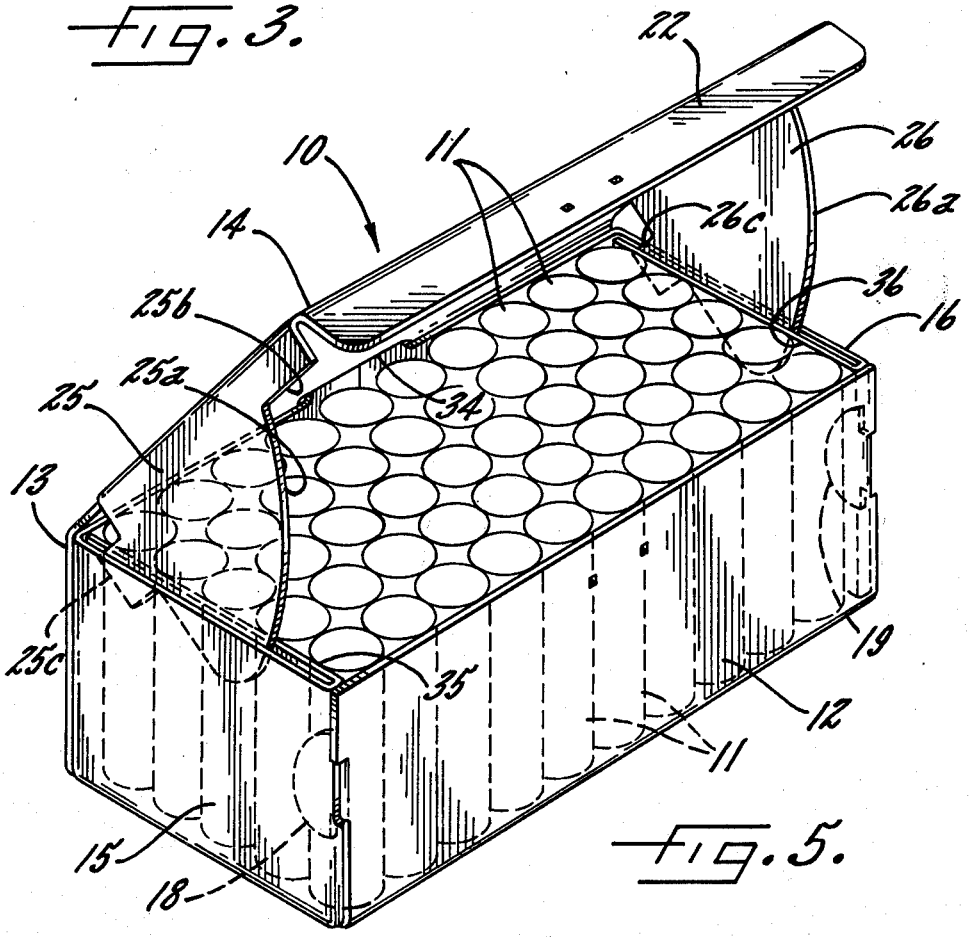
FIG. 5 is a perspective view of the same box shown in FIG. 4 with the fastening device removed and with a second side of the box partially open.

To permit the lid 14 to be readily opened, as illustrated in FIG. 5, the flaps 25 and 26 are provided with arcuate edges 25*a* and 26*a* so that these forward edges of the flaps remain clear of the folded area between the two plies of the double-thickness end wall during opening of the lid. For the purpose of stabilizing the flaps 25 and 26 while the lid 14 is in its closed position, the flaps 25 and 26 are designed to extend all the way down to the side wall 17, and integral tabs 25*b*, 25*c* and 26*b*, 26*c* are formed on the front and rear edges of the flaps 25 and 26 to engage the respective surfaces at the front and rear edges of the cavity formed between the two layers of the double-thickness end walls. Thus, when the lid 14 is in its closed position, the flaps 25 and 26 are stablized by the three-point support afforded by the flaps themselves and the tabs 25*b*, and 25*c* and 26*b*, 26*c* formed as integral parts thereof. This stabilizing effect of the flap structure can be seen most clearly in FIGS. 4 and *7c*. Also, when the lid 14 is partially open, as illustrated in FIG. 5 for example, the frictional engagement of the tabs 25*b*, 25*c* and 26*b*, 26*c* with the adjacent surfaces serve to hold the lid 14 in any desired position until the flaps 25 and 26 are completely withdrawn from the end walls.

Figure 2:
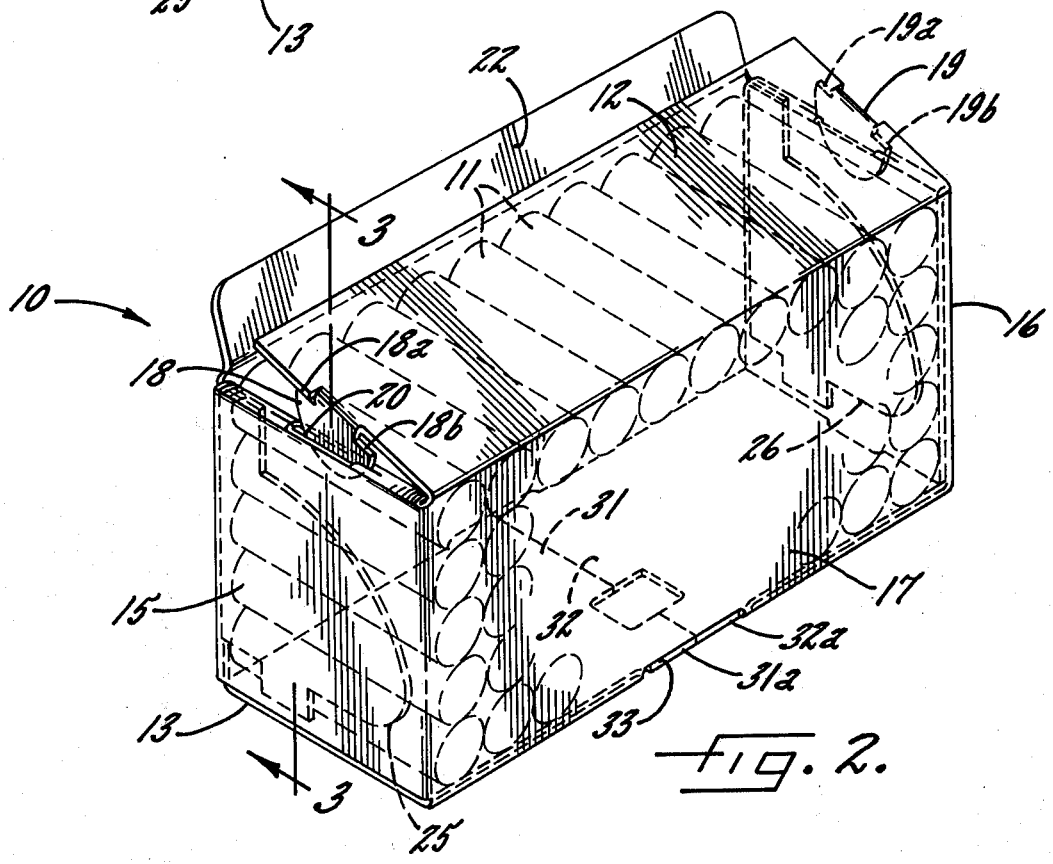
FIG. 2 is a perspective view of the same box illustrated in FIG. 1 with the open side of the box partially closed.
Figure 3:
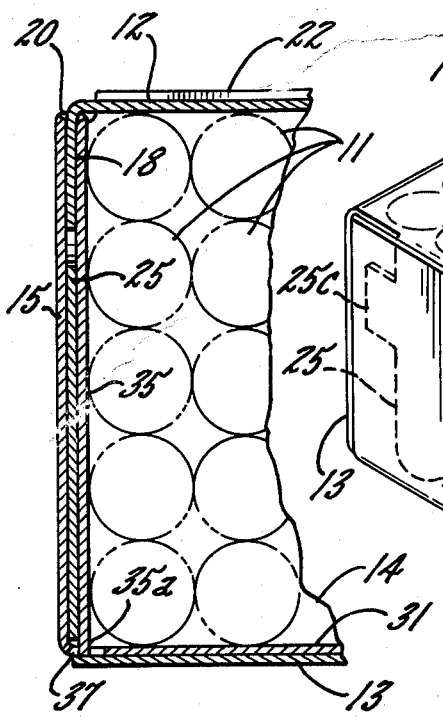
FIG. 3 is an enlarged fragmentary section taken along line 3—3 in FIG. 2.

The slots 20 and 21 which receive the tabs 18 and 19 on the ends of the lid 12 are formed in the centers of the fold lines between the end walls 15 and 16 and the flaps 35 and 36 formed as integral extensions thereof. As can be seen most clearly in FIGS. 1, 2 and 6, these slots 20 and 21 are formed by die cuts slits 20*a*, 20*b* and 21*a*, 21*b* at the ends thereof, and by cut outs 20*c* and 21*c* in the central regions thereof. Thus, the tabs 18 and 19 enter the center regions of the slots 20 and 21 quite easily, and then must be pressed with more force through the slits 20*a*, 20*b* and 21*a*, 21*b* to complete the insertion of the tabs 18 and 19 fully within the slots. After the slots 18 and 19 have been fully inserted, a pair of side shoulders 18*a*, 18*b* and 19*a*, 19*b* formed on opposite sides of the tabs permit the slit portions of the slots 20 and 21 to come together above the tab shoulders so as to hold the tabs 18 and 19 captive between the two layers of the double-thickness end walls, as can be seen most clearly in FIGS. 3 and 4. Also, the combination of the flaps 25 and 26 and the tables 18 and 19 in the space between the two layers of the double-thickness end walls avoids any voids of sufficient size to permit deformation of the end walls under the weight of the coin rolls packed in the box.

Thus, it can be seen that the illustrative box structure provides interior wall surfaces which are sufficiently smooth and uninterrupted that they do not interfere with the rolling and stacking of coin rolls within the box. More specifically, the only flaps that are exposed on the internal surfaces are the flaps 35 and 36 which form part of the double-thickness end walls, and the flaps 31 and 32 which overlay the side wall 13, and all of these flaps are provided with tabs on the free ends thereof to hold the flaps securely against the adjacent box walls. Furthermore, none of the flaps are located on the surfaces which guide the ends of the coin rolls, i.e., walls 14 and 17, so there is little or no possibility of the ends of the coin rolls becoming hung up on the interior surfaces of the box. Furthermore, the few cut-outs that are formed in the flaps, namely the cut-outs necessitated by the formation of the tabs 18, 19 and the flaps 25*c*, 26*c* in a unitary, one-piece blank, are sufficiently small that they do not interfere with the elongated side walls of the coin rolls which are the roll surfaces which come into contact with these flaps. In this connection, it should be noted that the tabs 25*c* and 26*c* formed on the respective flaps 25 and 26 are relatively short, in the direction perpendicular to the fold lines of these flaps, so that the complementary cut-outs formed in the flaps 31 and 32 are sufficiently small that they do not interfere with the coin rolls when they roll over the interior box surface formed by the flaps 31 and 32.

As can be seen from the foregoing description, this invention provides an improved coin roll box that assures reliable packaging of a preselected number of coin rolls therein, while also facilitating inspection of the number of coin rolls in the box after it has been packed. This improved coin roll box is particularly suitable for use in an automatic packaging system that rolls the coin rolls into the box by gravity, while still permitting the box to be opened at a later time to expose the ends of the coin rolls in the box for checking the number of rolls that have been packed therein. Furthermore, this improved coin roll box can be efficiently formed from a single unitary blank of corrugated cardboard or the like, it can be easily fabricated in different sizes to accommodate rolls of coins of different denominations, and it can be held securely together by a single staple or other suitable fastening device.

We claim as our invention:

1. A coin roll box formed from a unitary blank and comprising the combination of a. a first side wall that is detachable from three adjacent walls and integrally hinged to a fourth wall so as to form a first lid that can be opened to permit coin rolls to roll into the box during the loading thereof, b. a second side wall adjacent said first side wall and detachable from said first side wall and the two walls that are adjacent both the first and second side walls so as to form a second lid that can be opened to permit inspection of the ends of the coin rolls packed in the box, c. and a plurality of internal flaps formed as integral parts of the box walls and forming tabs which fit into complementary slots in the adjacent walls of the box to hold the box together, said tabs also holding said flaps against the respective box walls over which the flaps are folded so that the flaps do not interfere with the loading of the coin rolls into the box.

2. A coin roll box as set forth in claim 1 wherein a pair of opposed walls of the box are folded over on themselves to form double-thickness walls, and said lids form tabs that fit between the two layers of said double-thickness walls to at least partially connect said lids to said double-thickness walls.

3. A coin roll box as set forth in claim 2 wherein each of a pair of opposed walls of the box includes a pair of integral extensions at opposite ends thereof, one of the extensions of each wall being folded along the inner surface of the same wall to form a double-thickness wall, the other extension of each wall being folded along the adjacent wall of the box and having a pair of laterally extending tabs adapted to fit into complementary slots in adjacent walls of the box, thereby connecting said opposed walls to said adjacent walls of the box.

4. A coin roll box as set forth in claim 3 wherein tabs are formed on the ends of the extensions of said opposed walls which are folded along the inner surfaces thereof to form the double-thickness walls, said tabs being adapted to fit into complementary slots in said other extensions so as to hold together the two layers of the double-thickness walls.

5. A coin roll box as set forth in claim 3 wherein the two layers of each double-thickness wall are open along opposite edges thereof, and one of said lids includes integral tabs which fit through one of the open edges of each double-thickness wall and between the two layers thereof to detachably connect said lid to said double-thickness walls.

6. A coin roll box as set forth in claim 3 wherein a slot is formed in the fold between the two layers of each of said double-thickness walls, and one of said lids includes integral tabs which fit through said slots and between the two layers thereof to detachably connect said lid to said double-thickness walls.

7. A coin roll box as set forth in claim 1 wherein one of the adjacent detachable edges of said lids forms an integral flap that folds over a portion of the other lid so that the two lids can be fastened together.

8. A coin roll box as set forth in claim 1 wherein one pair of opposed internal walls of the box are spaced apart by a distance only slightly greater than the length of a coin roll so as to guide the ends of the coin rolls as they are rolled into the box.

9. A coin roll box as set forth in claim 8 wherein said pair of opposed internal walls of the box are continuous uninterrupted solid surfaces to avoid interference with the ends of the coin rolls.

10. A coin roll box formed from a unitary blank and comprising the combination of a. a pair of adjacent lids formed by adjacent side walls of the box which are detachable from each other and from a pair of end walls adjacent to both lids, said lids being integrally hinged to the respective side walls adjacent thereto so that the lids can be independently opened for loading and inspection of the coin rolls, b. one of said lids and the opposed side wall of the box being spaced apart by a distance only slightly greater than the length of one of the coin rolls so that said lid and opposed side wall serve as guides to maintain the coin rolls substantially parallel to each other during the packing thereof, said lid and opposed side wall forming continuous uninterrupted solid surfaces to avoid interference with the ends of the coin rolls.

* * * * *